US005367145A

United States Patent [19]

Takagi

[11] Patent Number: 5,367,145

[45] Date of Patent: Nov. 22, 1994

[54] HEATING APPARATUS WITH AUTOMATIC HEATING PERIOD SETTING FUNCTION

[75] Inventor: Minoru Takagi, Aichi, Japan

[73] Assignee: Kabushi Kaisha Toshiba, Kanagawa, Japan

[21] Appl. No.: 107,457

[22] Filed: Aug. 17, 1993

[30] Foreign Application Priority Data

Aug. 17, 1992 [JP] Japan ..... 4-217777

[51] Int. Cl.[5] ..... H05B 6/68

[52] U.S. Cl. ..... 219/494; 219/710; 219/705; 219/719; 99/325

[58] Field of Search ..... 219/10.55 B, 10.55 E, 219/10.55 R, 10.55 M, 492, 494, 506, 518, 702, 705, 707, 708, 710, 711, 719; 99/451, DIG. 14, 325

[56] References Cited

U.S. PATENT DOCUMENTS 4,009,359 2/1977 Tallmadge et al. ..... 219/10.55 B
4,301,509 11/1981 Haase et al. ..... 219/494
4,484,065 11/1984 Ueda ..... 219/492
4,568,810 2/1986 Carmean ..... 219/10.55 B
4,918,276 4/1990 Oh ..... 219/10.55 B
4,927,998 5/1990 Tamura et al. ..... 219/494
4,970,359 11/1990 Oh ..... 219/10.55 M

FOREIGN PATENT DOCUMENTS 61-61517 12/1986 Japan ..... H05B 6/68

*Primary Examiner*—Philip H. Leung
*Attorney, Agent, or Firm*—Limbach & Limbach

[57] ABSTRACT

A heating apparatus such as microwave ovens includes a heater heating food contained in a cooking chamber and a temperature sensor sensing the temperature in the cooking chamber. An initial temperature is detected at an initial stage of the cooking on the basis of the temperature sensed by the temperature sensor. An intermediate temperature is further detected a predetermined time period after the start of the cooking. Based on the difference between the detected initial and intermediate temperatures, a suitable cooking period of time is determined.

12 Claims, 9 Drawing Sheets

HEATING APPARATUS WITH AUTOMATIC HEATING PERIOD SETTING FUNCTION

BACKGROUND OF THE INVENTION

1. Field of the Invention

This invention relates to a heating apparatus including a heater provided for heating food by means of hot air or radiant heat, and more particularly to such a heating apparatus wherein a heating period of time is automatically set.

2. Description of the Prior Art

The prior art has provided for a heating apparatus in which a build-up characteristic of the temperature in a heating chamber is detected after the initiation of a heating operation in order that a heating time period can be automatically set. The detection of the build-up characteristic of the temperature in the heating chamber relies upon that it is dependent upon an amount of food to be cooked. In this type heating apparatus, a heater is energized to start the heating upon start of the cooking. Measurement is executed as to a period of time from the start of the cooking to a time the temperature in the heating chamber reaches a predetermined control temperature. A heating period of time is set in accordance with the results of the measurement. The heater is deenergized for completion of the heating when the set cooking time period has elapsed.

In the above-described heating apparatus, however, it takes much time for the temperature in the heating chamber to reach the control temperature when an amount of food to be cooked is relatively large. Accordingly, there is a problem that a user is informed of a remaining time period too late.

Furthermore, an initial temperature in the heating chamber is shifted largely from the normal state when an atmospheric temperature is very high or very low or when the cooking is repeated at short intervals. In such a case, the the heating time period automatically set on the basis of the detected temperature is also shifted largely from an optimum heating time period. Consequently, there arises a problem that an error in the automatically set heating time period is increased.

SUMMARY OF THE INVENTION

Therefore, a primary object of the present invention is to provide a heating apparatus wherein the heating time period suitable for the amount of food to be heated can be determined readily a predetermined period after the start of the cooking.

A second object of the invention is to provide a heating apparatus wherein a user can be informed of a determined heating time period.

A third object of the invention is to provide a heating apparatus wherein a suitable heating time period can be determined as to whether food to be cooked is a marinated one or not.

A fourth object of the invention is to provide a heating apparatus wherein the user can be informed of a timing for inversion of the food being cooked.

To achieve the primary object, the invention provides a heating apparatus comprising a heating chamber for accommodating food to be cooked by way of heating, a heater for heating the food accommodated in the heating chamber, and a temperature sensor for sensing a temperature in the heating chamber, thereby generating a temperature signal indicative of the sensed temperature. First means is connected to the temperature sensor for obtaining an initial temperature on the basis of the temperature signal generated by the temperature sensor at an initial stage of the heating. Second means is connected to the temperature sensor for obtaining an intermediate temperature on the basis of the temperature signal generated by the temperature sensor a predetermined period after the initial stage of the heating. Third means is connected to the first and second means for obtaining the difference ($Y_B$) between the initial temperature obtained by the first means and the intermediate temperature obtained by the second means. Fourth means is connected to the third means for determining a calorific capacity of the food on the basis of the difference ($Y_B$) obtained by the third means. Heating time period determining means is connected to the fourth means for setting a heating period of time for the food on the basis of the calorific capacity determined by the fourth means.

Preferably, the determination data further includes a fundamental temperature difference ($Y_\alpha$) determined on the basis of the initial temperature and the heating time period determining means determines the heating period of time based on a difference between the temperature difference ($Y_\beta$) and the fundamental temperature difference ($Y_\alpha$).

To achieve the second object, a clock display is provided for displaying the heating period of time determined by the heating time period determining means.

To achieve the third object, the heating apparatus further comprises an alcohol sensor detecting an alcoholic content in the heating chamber. The heating time period determining means determines whether the food in the heating chamber is a marinated food or not, on the basis of a rate of change of the alcoholic content detected by the alcohol sensor, thereby compensating the determined heating period of time in accordance with a result of the determination as to whether the food in the heating chamber is a marinated food or not.

To achieve the fourth object, the heating apparatus further comprises a character display. The heating time period determining means operates the character display to display an indication of "Reverse" after lapse of the time period for broiling an obverse of the food.

Other objects of the present invention will become obvious upon understanding of the illustrative embodiment about to be described with reference to the accompanying drawings. Various advantages will occur to those skilled in the art upon employment of the invention in practice.

BRIEF DESCRIPTION OF THE DRAWINGS

An embodiment of the invention will be described with reference to the accompanying drawings, in which.

DESCRIPTION OF THE PREFERRED EMBODIMENT

Figure 2:
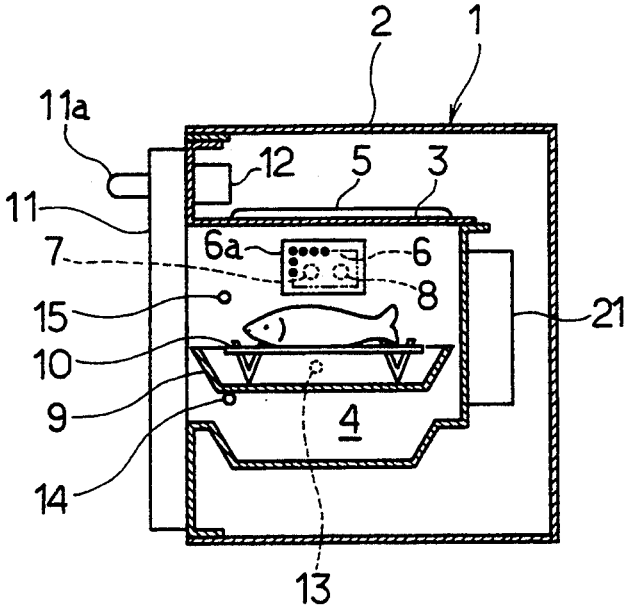
FIG. 2 is a longitudinally sectional view of the heating apparatus.

The embodiment of the present invention will be described with reference to the accompanying drawings. Referring first to FIG. 2 illustrating a heating apparatus, a body 1 includes an outer casing 2 and an inner casing 3. The inner casing 3 defines therein a heating chamber 4. A heater 5 comprising a flat heater is mounted on the outer face of a ceiling of the inner casing 3 for heating the same, thereby heating food contained in the heating chamber 4.

An air outlet 6 is formed in one of side walls of the inner casing 3. A cover 6*a* having a number of small holes is attached to the side wall to cover the air outlet 6. An alcohol sensor 7 and a steam sensor 8 are provided in an exhaust path (not shown) extending from the air outlet 6 and communicating with the outside of the apparatus. A mounting pan 9 is detachably mounted in the heating chamber 4. A gridiron 10 is adapted to be placed on the mounting pan 9. The front opening of the heating chamber 4 is closed and opened by a door 11 having a knob 11*a*. A door switch 12 is mounted on the front of the body 1 for detecting the opening and closure of the door 11.

A photosensor 13 is provided in the heating chamber 4 for detecting presence or absence of the mounting pan 9 therein. A temperature sensor or more particularly, a grill temperature sensor 14 for a grill mode is provided in the heating chamber 4 so as to be positioned below the mounting pan 9. An oven temperature sensor 15 for an oven mode is also provided in the cooking chamber 4 so as to be positioned over the mounting pan 9.

Figure 1:
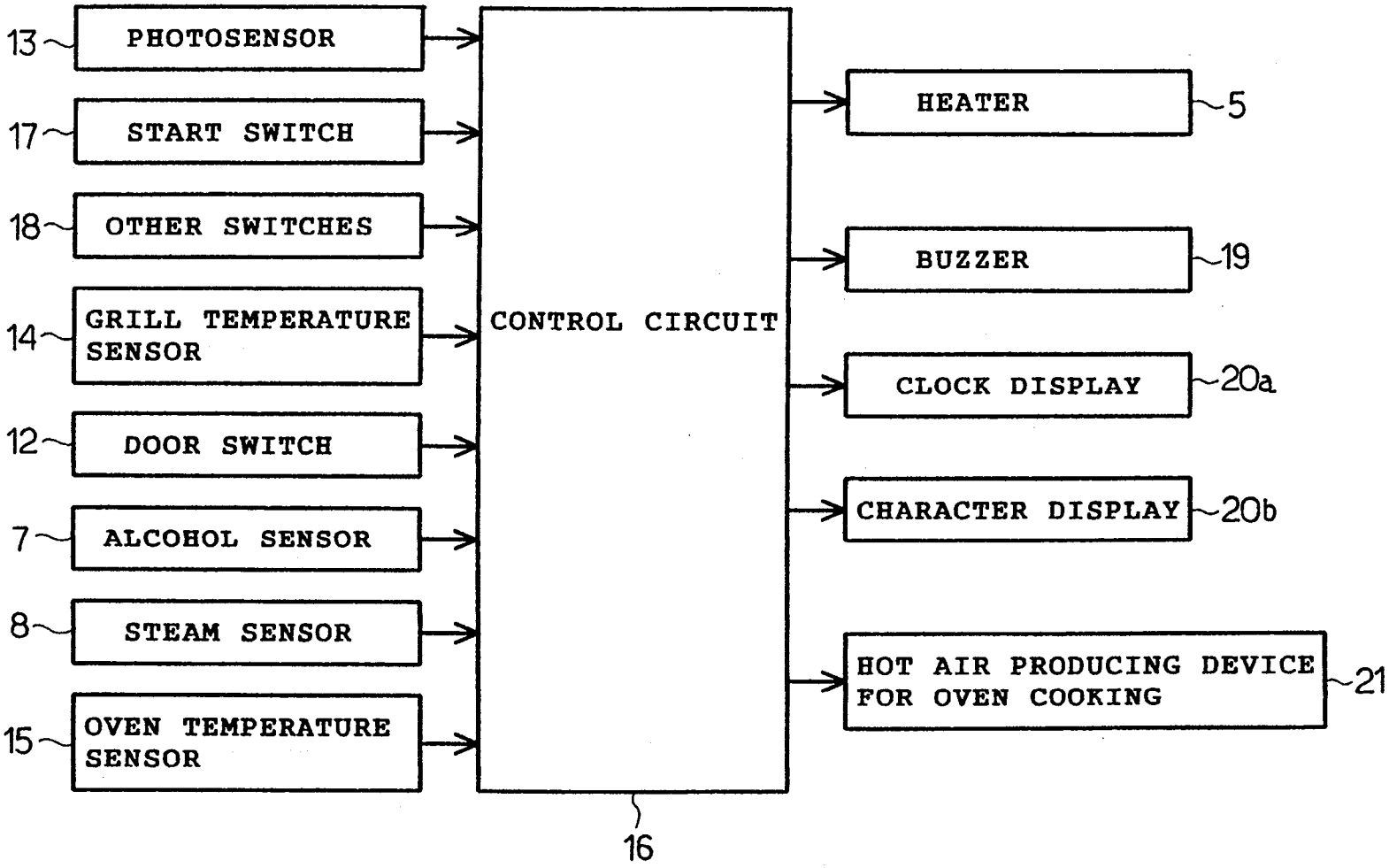
FIG. 1 is a block diagram showing an electrical arrangement of the heating apparatus of the embodiment in accordance with the invention.
Figure 3:
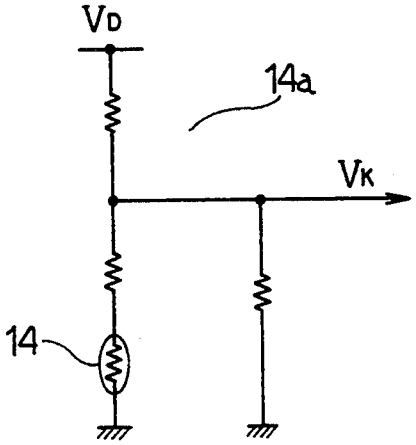
FIG. 3 is a circuit diagram showing a sensor circuit of a grill temperature sensor.

FIG. 1 illustrates an electrical arrangement of the heating apparatus. A control circuit 16 is composed of a microcomputer, an analog-to-digital (A/D) converter and drive circuits for various loads, none of them being shown. The control circuit 16 is provided with a sensor circuit 14*a* for the grill temperature sensor 14, as shown in FIG. 3. The grill temperature sensor 14 comprises a thermistor having negative characteristics. When the temperature sensed by the grill temperature sensor 14 changes in a range between 240° C. and 0° C. the sensor circuit 14*a* generates an output signal $V_k$ whose magnitude is approximately inversely proportional to the temperature change.

Switch signals are supplied from the door switch 12, a start switch 17 and other switches 18 to the control circuit 16. Furthermore, output signals are also supplied from the photosensor 13, alcohol sensor 7, steam sensor 8 and oven temperature sensor 15 to the control circuit 16. The control circuit 16 controls the loads, that is, the heater 5, a buzzer 19, a clock display 20*a*, a character display 20*b* and a hot air producing device 21 for the oven cooking in accordance with an operation program. The hot air producing device 21 comprises the oven heater and a fan, as well known in the art. The control circuit 16 is so programmed as to serve, by means of software, as temperature sensing control means and heating time period determining means, both of which means will be described later.

The operation of the heating apparatus will now be described with functions of the control circuit 16 with reference to FIGS. 4 and 5. An experiment made by the inventor will be first described. Foods employed in the experiment include marinated fish such as a broiled yellowtail with soy, a "Saikyoyaki" Spanish mackerel or a broiled Spanish mackerel with "miso" and soy and a broiled mackerel with citron and unmarinated fishes such as a broiled salted Pacific saury and a broiled salted horse mackerel. In the case of the broiled yellowtail with soy, the yellowtail is marinated in the mixture of sugar, soy sauce and "mirin" which is a Japanese alcoholic flavoring, before being broiled. In the broiled Spanish mackerel with "miso" and soy, the Spanish mackerel is marinated in the mixture of "miso," Japanese saké, "mirin" and soy sauce. In the broiled mackerel with citron, the mackerel is marinated in the mixture of Japanese saké, mirin and soy sauce with sliced citron put on its top.

Figure 6:
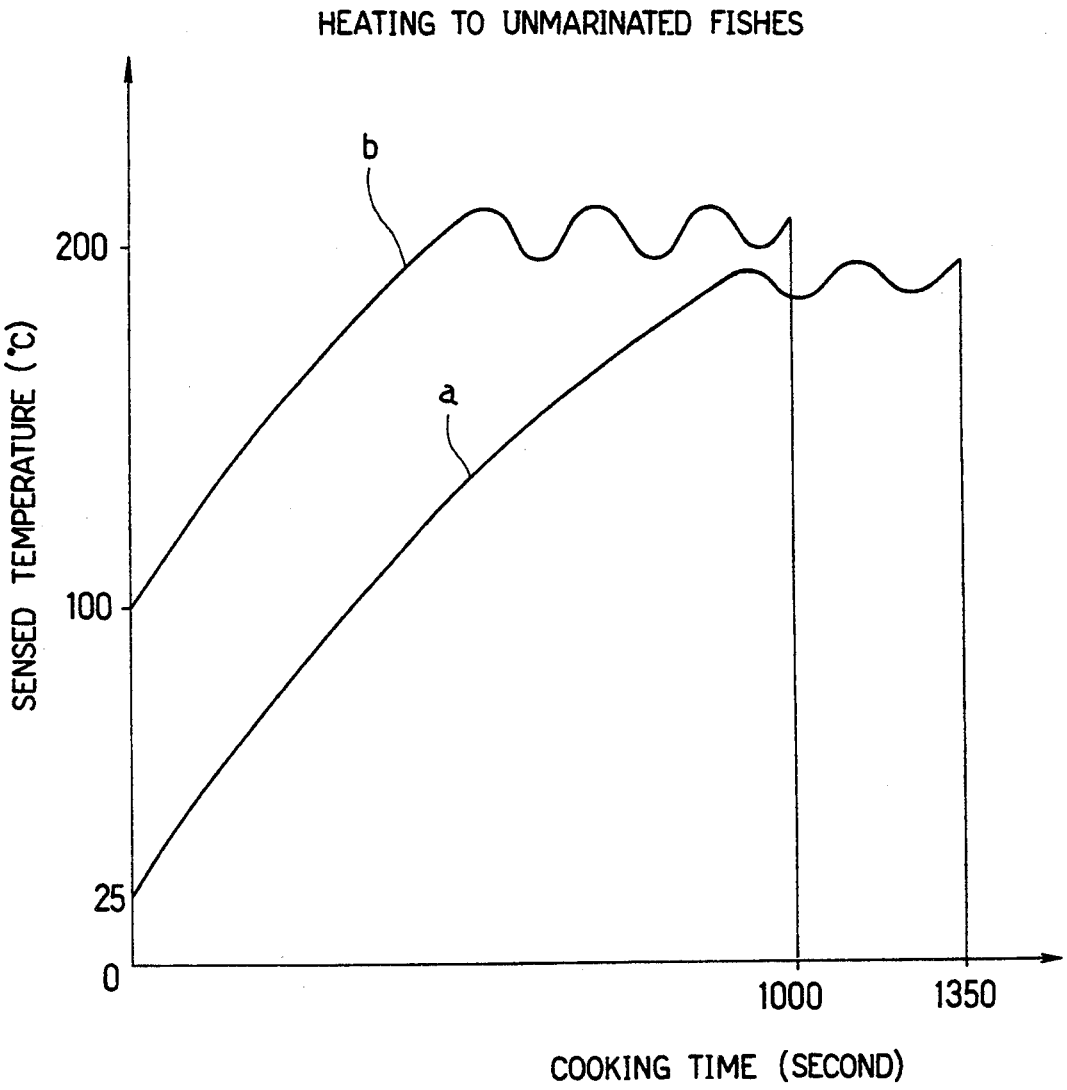
FIG. 6 is a graph showing the relation between the changes in the detected temperatures and the heating period of time in the condition of different initial temperatures.

FIG. 6 shows changes of the detected temperatures in the case of broiling four Pacific sauries as the unmarinated fish. Characteristic curve a shows the case where an initial temperature is at 25° C. and characteristic curve b shows the case of repeated cooking at the initial temperature of 100 ° C.

Figure 7:
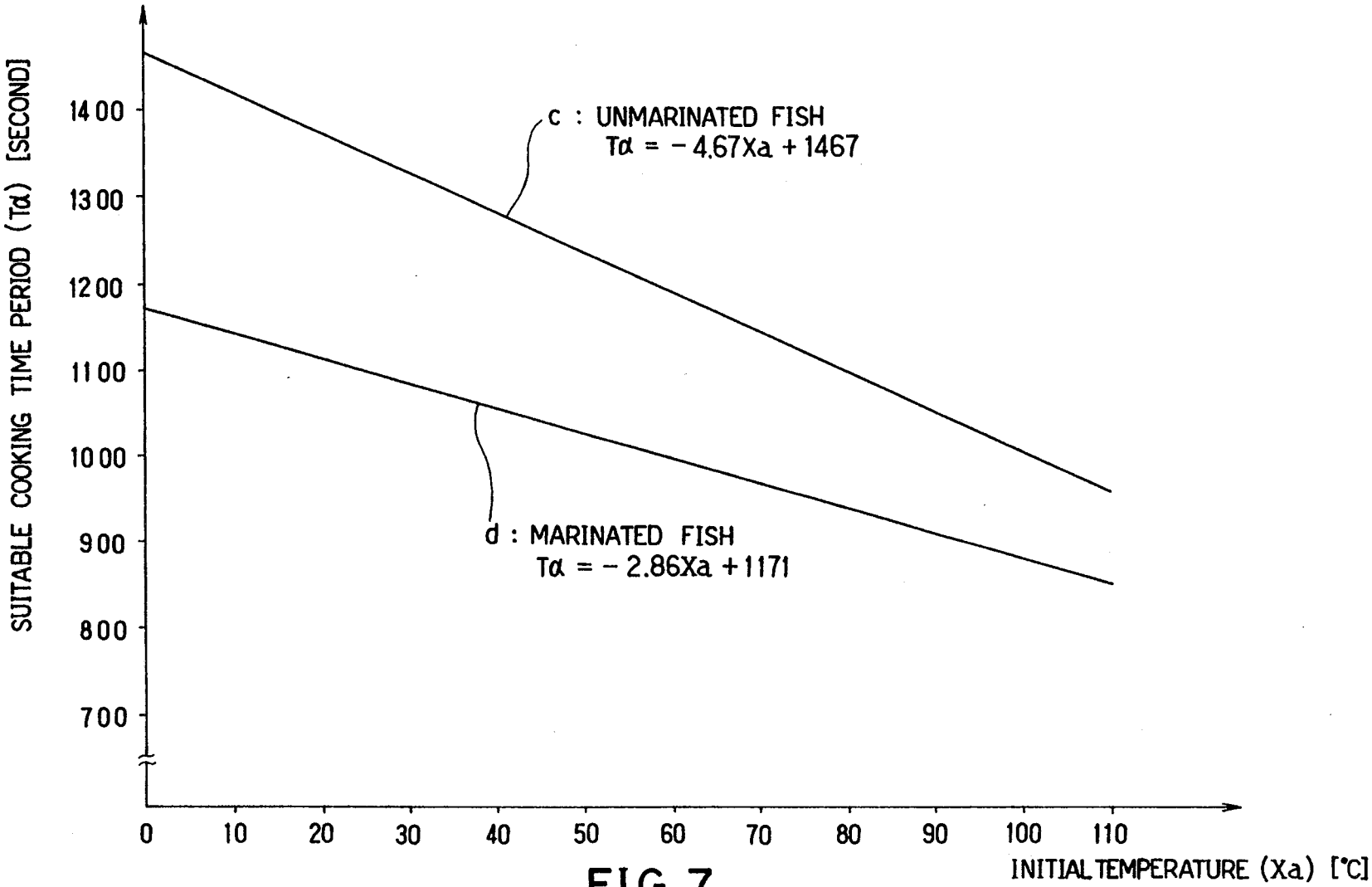
FIG. 7 is a graph showing the relation between the initial temperature and the suitable heating period of time.

FIG. 7 shows the linear relation between the initial temperature $X_a$ with respect to a predetermined amount of food to be heated or a fundamental calorific capacity and a suitable heating time period $T_\alpha$ (fundamental heating time period). In the figure, characteristic curve c shows the case where an unmarinated fish is broiled and characteristic curve d shows the case where a marinated fish is broiled. From FIGS. 6 and 7, it is understood that the suitable cooking time period $T_\alpha$ is shortened as the initial temperature $X_a$ becomes higher. Furthermore, it is understood that the suitable heating time period $T_\alpha$ becomes longer in the unmarinated fish than in the marinated fish.

The suitable cooking time period $T_\alpha$ is obtained from the following equations (1) and (2):

$$T_\alpha = -4.67X_a + 1467 \quad (1)$$

in the case of the unmarinated fish and $$T_\alpha = -2.86X_a + 1171 \quad (2)$$

in the case of the marinated fish.

Figure 8:
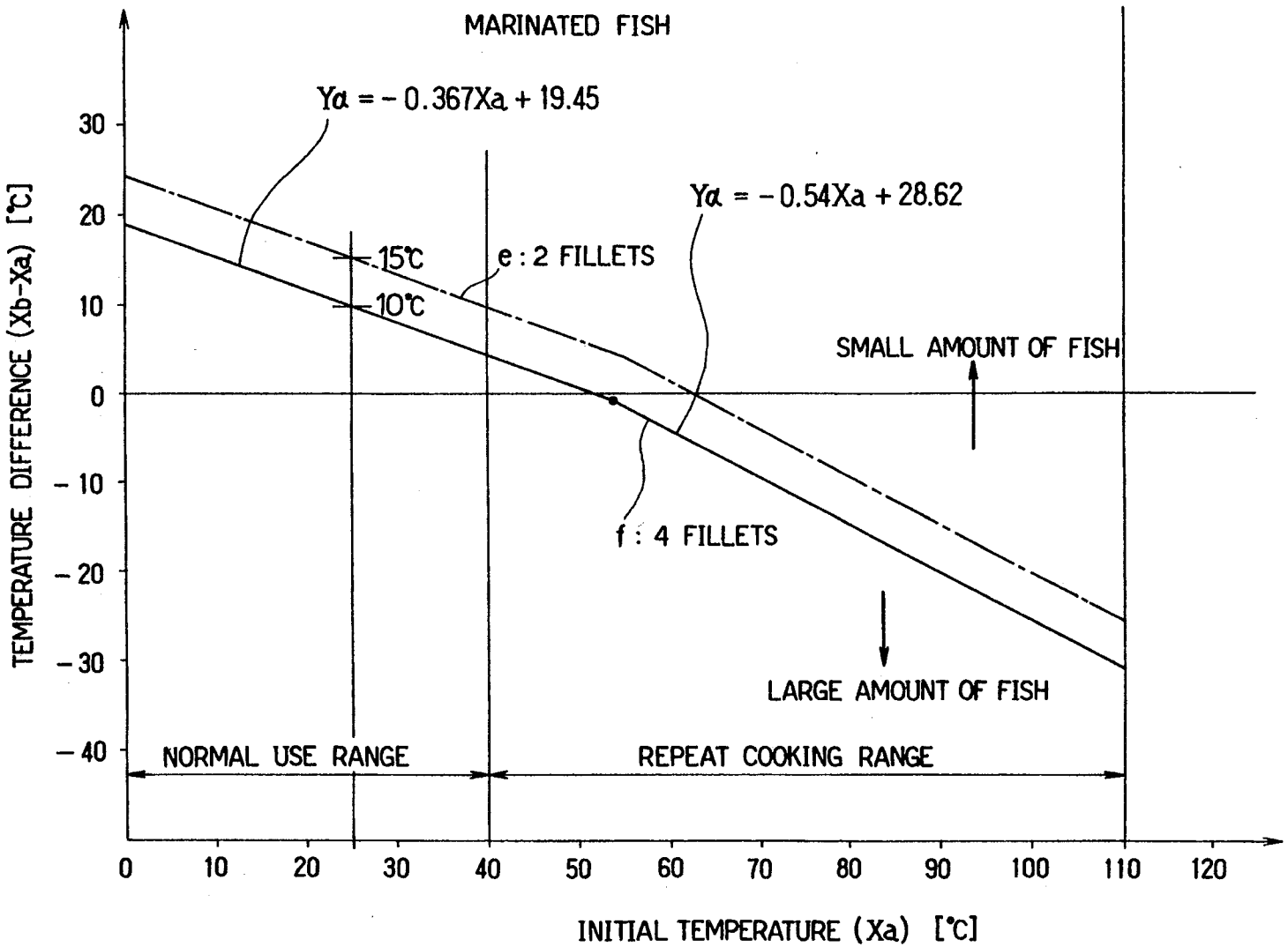
FIG. 8 is a graph showing the relation among the initial temperature, temperature difference and amount of marinated fish when it is cooked.

FIG. 8 shows the relation between the initial temperature $X_a$ and the difference between the initial temperature $X_a$ and an intermediate temperature $X_b$ a predetermined time period after the start of the heating (8 minutes after that in the embodiment) with the amount of the food (the fundamental calorific capacity) as a parameter. Characteristic curve e shows the case of two fillets of the marinated fish as the fundamental calorific capacity and characteristic curve f shows the case of four fillets. For example, the temperature difference $(X_b - X_a)$ is approximately 15° C. in the case of two fillets of the marinated fish when the initial temperature $X_a$ is 25° C. while in the case of four fillets of the marinated fish, it is approximately 10° C. Accordingly, it can be supposed that an amount of fish or the number of fillets of fish becomes larger as the temperature difference is small.

The above-mentioned temperature difference ($X_b - X_a$) may take a negative value for the following reason: in the repeat cooking, the temperature in the cooking chamber 4 is sufficiently high when the previous cooking has been completed. In this condition, the initial temperature $X_a$ sensed by the temperature sensor 14 is sufficiently high when a subsequent food or fish is put into the heating chamber 4 and the heating is initiated. However, the heat in the heating chamber 4 is absorbed into the food since the temperature in the heating chamber 4 is higher than the temperature of the food heated by the heater 5 with progress of the heating. Consequently, the temperature in the heating chamber 4 is decreased and accordingly, the intermediate temperature $X_b$ becomes lower than the initial temperature $X_a$.

From the foregoing, it can be determined that the heating apparatus is in a usual cooking mode when the initial temperature is in the range between 0° C. and 40° C. and that it is in the repeat cooking mode when the initial temperature is in the range between 41° C. and 110° C. In the actual repeat cooking, however, the initial temperature scarcely exceeds 100° C.

The temperature difference $Y_\alpha$ shown by the characteristic curve f in the case of four fillets of fish, which difference will be referred to as a fundamental temperature difference, is shown by the following equations (3) and (4) and serves as determination data:

$$Y_\alpha = -0.367X_a + 19.45 \quad (3)$$

where $5 \leqq X_a \leqq 53$ and $$Y_\alpha = -0.54X_a + 28.62 \quad (4)$$

where $53 < X_a \leqq 110$.

Thus, the fundamental temperature difference $Y_\alpha$ has different values for every fundamental calorific capacity and is further varied in accordance with the initial temperature $X_a$.

Figure 9:
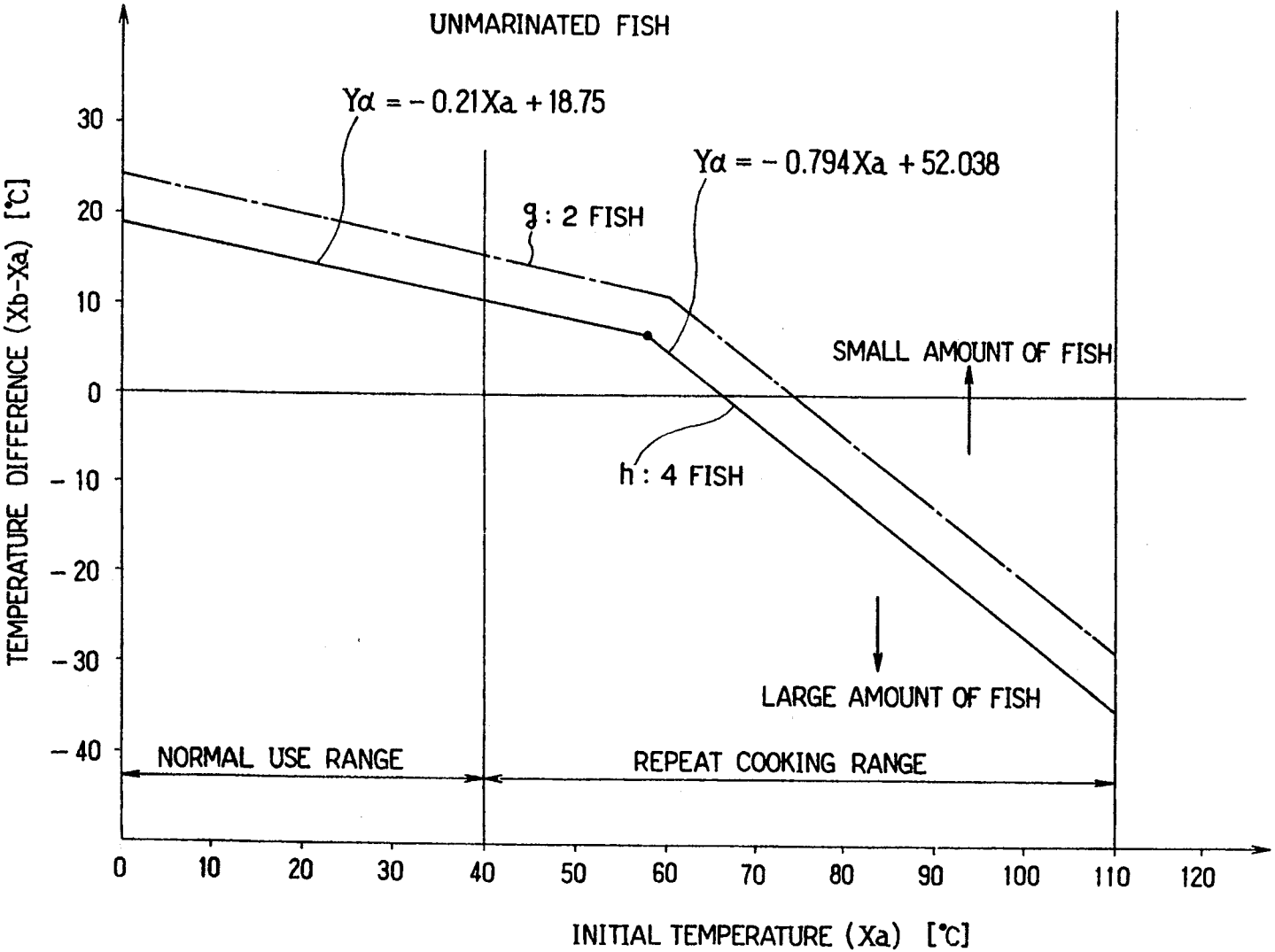
FIG. 9 is a graph showing the relation among the initial temperature, temperature difference and amount of unmarinated fish when it is heated.

FIG. 9 shows the relation between the initial temperature $X_a$, the difference between the initial temperature $X_a$ and the intermediate temperature $X_b$ a predetermined time period after the start of the heating (8 minutes after that in the embodiment) with the amount of the food as a parameter. Characteristic curve g shows the case of two unmarinated fish and characteristic curve h shows the case of four unmarinated fish. FIG. 9 can be understood in the same manner as in FIG. 8.

The fundamental temperature difference $Y_\alpha$ shown by the characteristic curve h in the case of four unmarinated fish is represented by the following equations (5) and (6):

$$Y\alpha = -0.21X_a + 18.75, \quad (5)$$

where $5 \leqq X_a \leqq 57$ and $$Y_\alpha = -0.794X_a + 52.038, \quad (6)$$

where $57 < X_a \leqq 110$.

Figure 4:
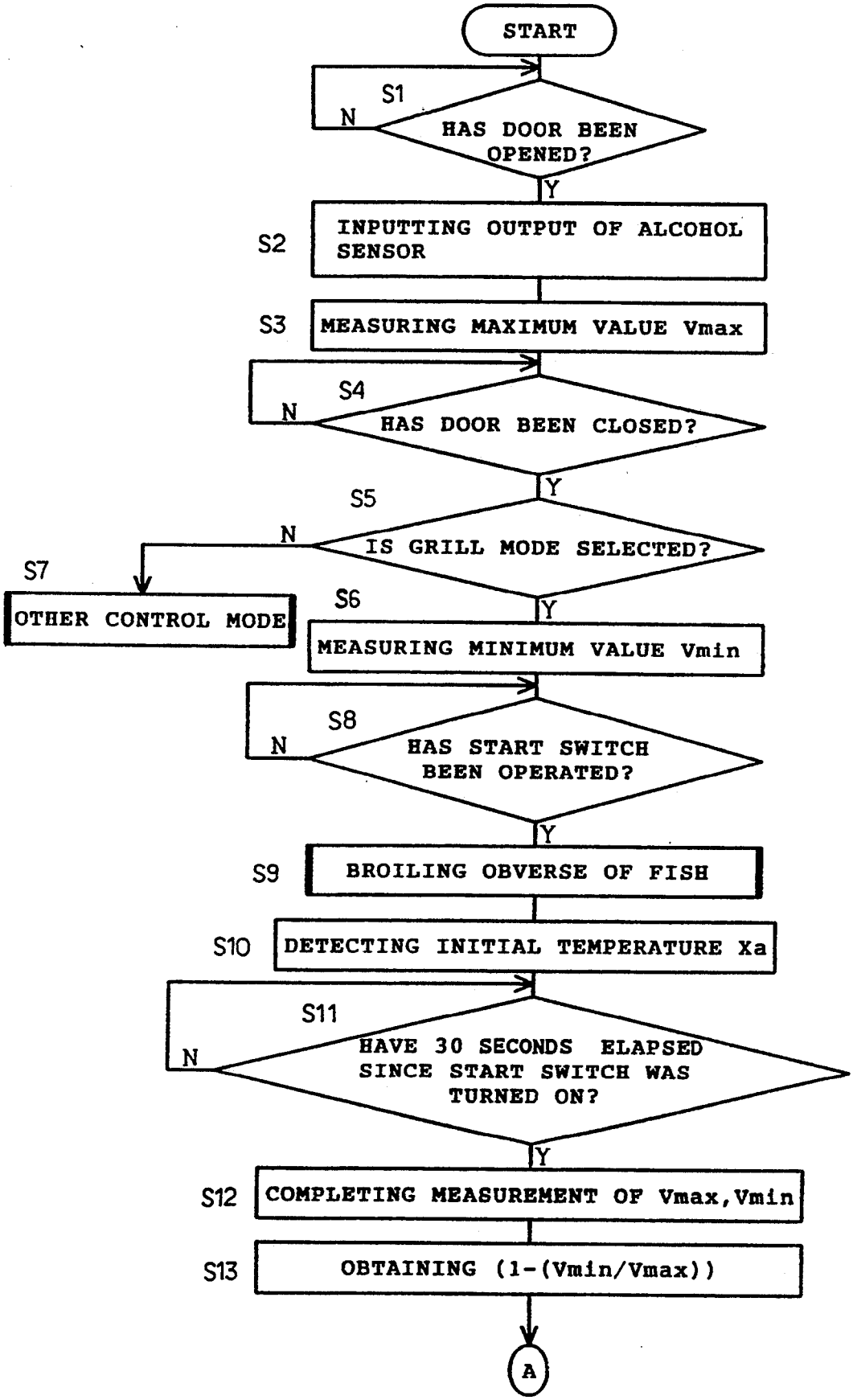
FIG. 4 is a flowchart showing the control contents.
Figure 4:
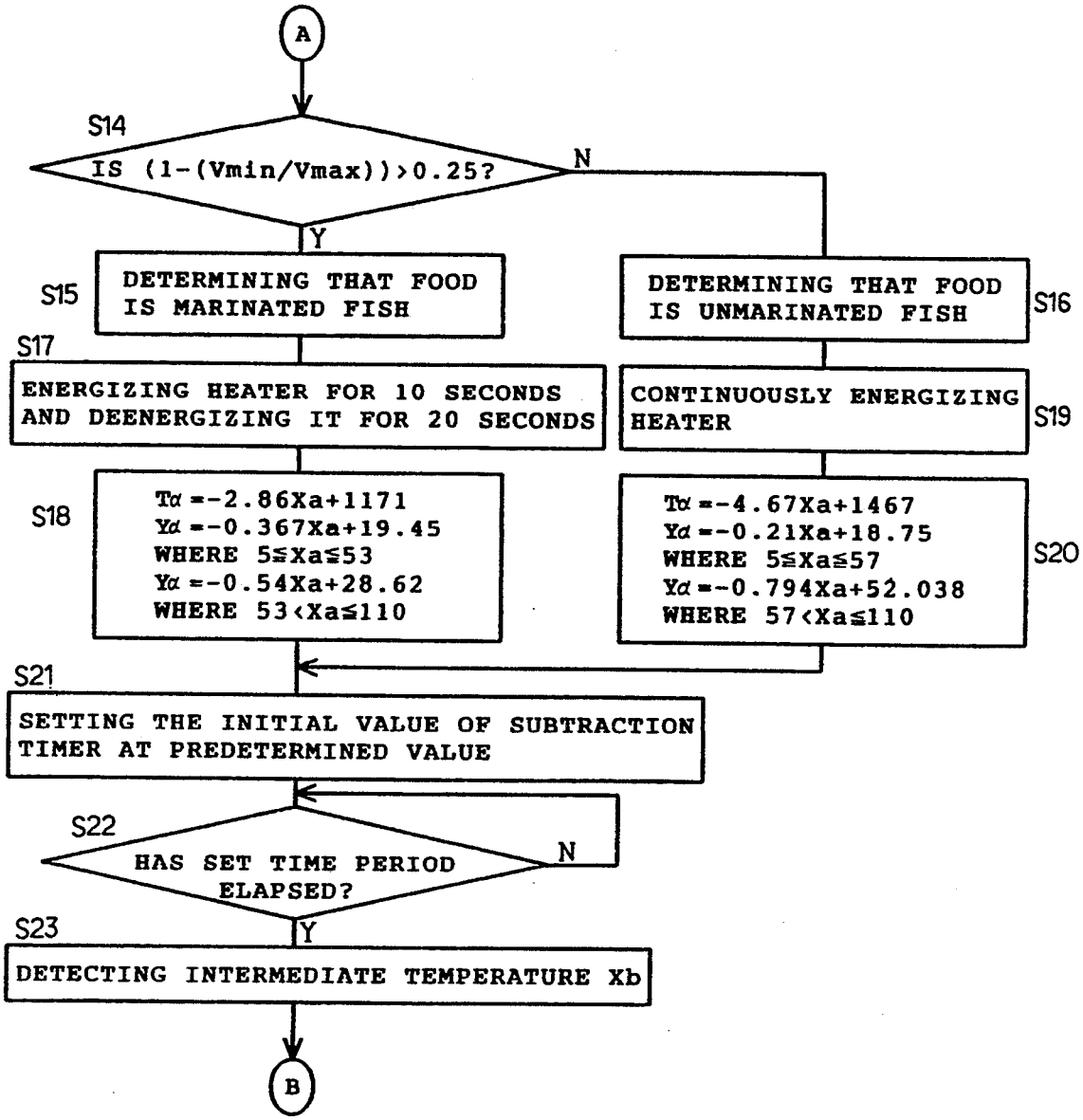
Figure 5:
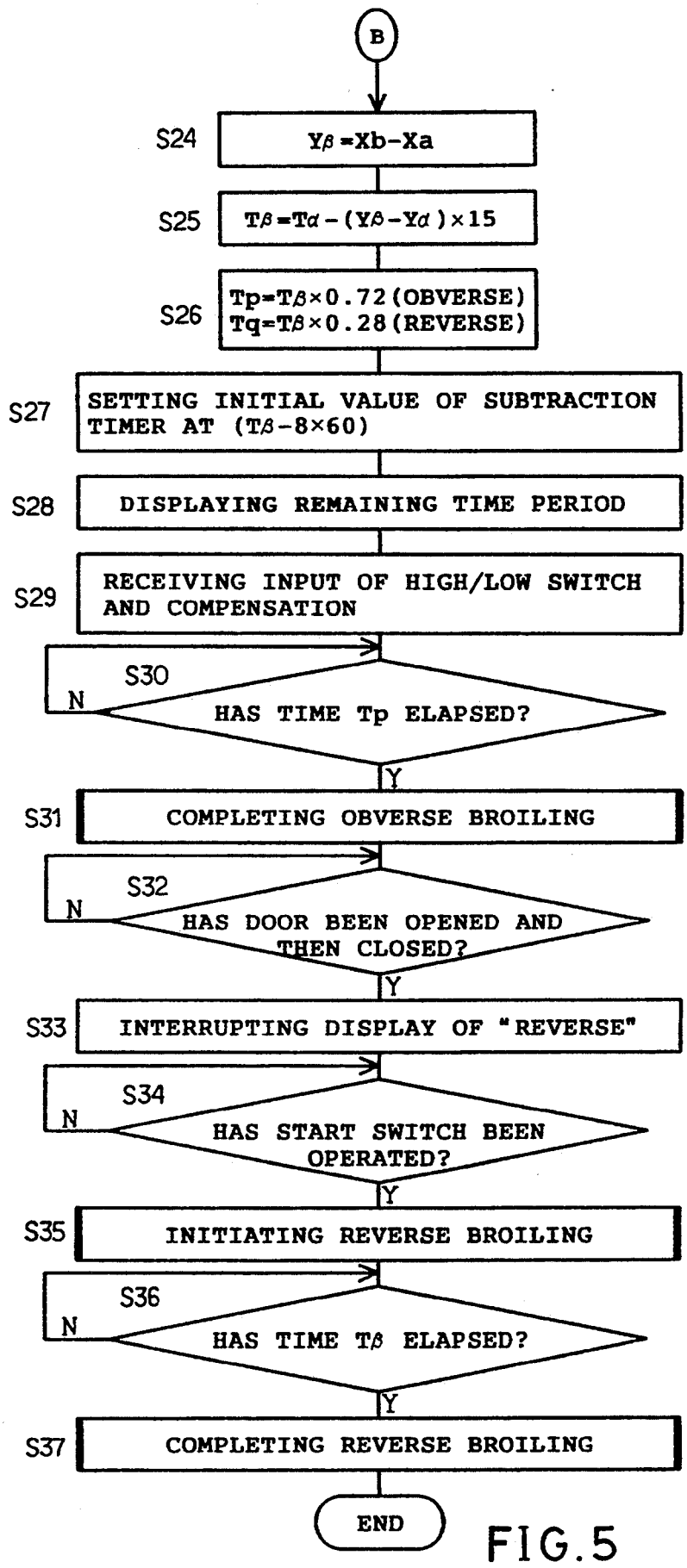
FIG. 5 is also a flowchart showing the control contents.

Referring now to FIGS. 4 and 5, the control manner of the control circuit 16 will be described. In the flowchart of FIG. 4, an automatic operation starts when an automatic operation mode is selected by a selecting switch (not shown). Based on the signal from the door switch 12, the control circuit 16 determines whether the door 11 has been opened or not, at step S1. The control circuit 16 then inputs the output of the alcohol sensor 7 at step S2 and measures the maximum output value $V_{max}$ of the sensor 7. Then, the control circuit 16 determines whether the door 11 has been closed or not, at step S4. In steps S1 and S4, it is determined that the food has been contained in the heating chamber 4.

Subsequently, the control circuit 16 determines whether the grill mode is selected or not, at step S5. This determination is based on the presence or absence of an output of the photosensor 13 detecting the mounting pan 9. When the mounting pan 9 is disposed in the heating chamber 4, the control circuit 16 determines that the grill mode is selected, advancing to step S6. When the mounting pan 9 is not disposed in the heating chamber 4, the control circuit 16 determines that the grill mode is not selected, advancing to step S7 where the control is performed in accordance with another mode.

When determining that the grill mode has been selected, the control circuit 16 measures the minimum output value $V_{min}$ of the alcohol sensor 7, at step S6. When the control circuit 16 determines at step S8 that the start switch 17 has been turned on, a heating process is initiated and first, broiling the obverse of the fish is initiated at step S9. In the obverse broiling operation, the buzzer 19 is activated once and the indication "under cooking" is displayed on the character display **20*b*. Furthermore, the heater 5** is continuously energized.

Subsequently, based on the output of the grill temperature sensor 14, the control circuit 16 detects the then determines whether 30 seconds have elapsed since the initial temperature $X_a$ at step S10. The control circuit 16 then determines whether 30 seconds have elapsed since the start switch 17 was turned on, at step S11. When 30 seconds have elapsed, the control circuit 16 completes the measurement of the maximum and minimum output values $V_{max}$, $V_{min}$ of the alcohol sensor 7, at step S12. The control circuit 16 obtains the rate of change $(1-(V_{min}/V_{max}))$ of the amount of produced alcoholic gas from the maximum and minimum values $V_{max}$, $V_{min}$ in order to determine which the food is, a marinated fish or an unmarinated fish. More specifically, a relatively large amount of alcoholic component is contained in the marinated fish such as the broiled yellowtail, Spanish mackerel broiled with "miso" and soy, mackerel broiled with citron. Actually, the alcoholic component is contained in these fishes since they are marinated in the alcoholic flavorings before being broiled. On the other hand, a relatively small amount of alcoholic component is contained in the unmarinated fish such as the broiled salted Pacific saury and the broiled salted horse mackerel. Accordingly, based on the change rate of the amount of alcohol produced in the heating chamber 4, it can be determined which the food is, the marinated or unmarinated fish. The output voltage of the alcohol sensor 7 is set to be inversely proportional to the amount of produced gas and accordingly, it can be determined that the amount of alcoholic component is large as the change rate, $(1-(V_{min}/V_{max}))$, becomes larger.

The control circuit 16 determines at step S16 that the food is a marinated fish, when the change rate of the amount of produced gas exceeds 0.25 and further determines that the food is an unmarinated fish, when the change rate of the amount of produced gas is 0.25 or below. When it is determined that the food is a marinated fish, the heating operation is changed to a mode in which the heater 5 is repeatedly energized for 10 seconds and deenergized for 20 seconds alternately, at step S17. The control circuit 16 then obtains, from the initial temperature $X_a$, a fundamental or suitable heating time period $T_\alpha$ with respect to the fundamental calorific capacity and the fundamental temperature difference $Y_\alpha$, at step S18. The fundamental heating time period $T_\alpha$ is obtained by the above equation (2) and the fundamental temperature difference $Y_\alpha$ is obtained by the above equations (3) and (4).

On the other hand, when it is determined that the food is an unmarinated fish, the heater 5 is continuously energized, at step S19. The control circuit 16 then obtains, from the initial temperature $X_a$, the fundamental heating time period $T_\alpha$ and the fundamental temperature difference $Y_\alpha$, at step S20. The fundamental heating time period $T_\alpha$ is obtained by the above equation (1) and the fundamental temperature difference $Y_\alpha$ is obtained by the above equations (5) and (6).

After step S18 or S20, .an initial value of a subtraction timer ( not shown ) incorporated as a software timer in the control circuit 16 is set to a predetermined value or 7 minutes and 30 seconds in this case, at step S21. More specifically, where the time the start switch 17 was turned on is the starting point, the initial value is set to 8 minutes since 30 seconds have elapsed. Upon lapse of the time period set at the subtraction timer at step S22, the control circuit 16 obtains the intermediate temperature $X_b$ from the temperature sensed by the grill temperature sensor 14 at step S23. Then, an actual temperature difference $Y_\beta(Y_\beta=X_b-X_a)$ serving as determination data is obtained from the intermediate temperature $X_b$ and the initial temperature $X_a$, at step S24. The heating time period $T_\beta$ (second) is then determined at step S25. The cooking time period $T_\beta$ is obtained from the following equation (7):

$$T_\beta=T_\alpha-(Y_\beta-Y_\alpha)\times 15. \quad (7)$$

The actual temperature difference $Y_\beta$ takes a value in accordance with the actual calorific capacity. Accordingly, when the actual temperature difference $Y_\beta$ is larger than the initial fundamental temperature difference $Y_\alpha$ at this time, it can be determined from FIGS. 8 and 9 -that the amount of fish is smaller than the fundamental calorific capacity. The heating time period to be set should be shorter than the fundamental heating time period $T_\alpha$. The coefficient "15" in the equation (7) is one of the factors determining an amount of compensation corresponding to the difference between the fundamental calorific capacity and the actual capacity and was obtained from experiments. A time period of 15 seconds (the coefficient 15) is added to or subtracted from the fundamental heating time period when the difference between the actual temperature difference $Y_\beta$ and the fundamental temperature difference $Y_{60}$ is "1" in the equation (7).

Subsequently, a broiling time period $T_p$ for an obverse of the fish and a broiling time period $T_q$ for a reverse of the fish are determined at step S26. These time periods $T_p$, $T_q$ are obtained from the following equations:

$$T_p=T_\beta\times 0.72$$

and $$T_q=T_\beta\times 0.28.$$

The initial value of the subtraction timer is set to a value of $(T_\beta-8\times 60)$ seconds at step S27. The sequentially subtracted remaining time period is displayed on the clock display 20*a* at step S28. Then, the control circuit 16 receives an input of a HIGH/LOW switch regarding the heating power at step S29. When the control circuit 16 receives the input of the HIGH/-LOW switch, "one minute" is added to or subtracted from the heating time period $Y_\beta$. In this case, too, the addition or subtraction is applied to the time displayed on the clock display 20*a*.

Subsequently, upon lapse of the time period $T_p$ at step S30, the broiling of the obverse of the fish is completed at step S31. More specifically, the heater 5 is deenergized and the buzzer 19 is activated to produce an alarming sound. Furthermore, the indication displayed on the display 20*b* is changed from "Under cooking" to "Reverse." When it is determined at step S32 that the door 11 has been opened and then, closed or when the fish in the heating chamber 4 has been reversed by the user, display of "Reverse" is interrupted at step S33. Then, when it is determined at step S34 that the start switch 17 has been turned on, the broiling of the reverse of the fish is initiated at step S35. In the broiling of the reverse of the fish, the heater 5 is energized and the buzzer 19 is activated to perform an alarming once. Furthermore, the indication of "Under cooking" is displayed on the character display 20*b*.

Upon lapse of the heating time period $T_\beta$ at step S36, the broiling of the reverse of the fish is completed at step S37 and then, the heating is completed. In the processing for the completion of the reverse broiling, the heater 5 is deenergized and the buzzer 19 is activated to produce an alarming sound. Furthermore, the indication displayed on the display 20*b* is changed from "Under cooking" to "Finished."

According to the above-described embodiment, the initial temperature $X_a$ is sensed at the initial stage of the heating and the intermediate temperature $X_b$ is sensed the predetermined time (8 minutes ) after initiation of the heating. The heating time period $T_\beta$ is determined from the temperature difference $Y_\beta$ between the initial temperature and the intermediate temperature. Accordingly, the heating time period $T_\beta$ can be always determined at the time after lapse of the predetermined time from the start of the heating. Furthermore, the intermediate temperature $X_b$ sensed the predetermined time period after initiation of the heating is taken into consideration as well as the initial temperature in the determination of the heating time period. Consequently the suitable heating time period $T_\alpha$ can be determined even when the room temperature is excessively high or low or even when the initial temperature is shifted largely from the normal state.

In the embodiment, particularly, the fundamental temperature difference $Y_\alpha$ is obtained on the basis of the initial temperature $X_a$ and thereafter, the actual temperature difference $Y_\beta$ between the initial temperature $X_a$ and the intermediate temperature $X_b$ is compared with the above-mentioned fundamental temperature difference $Y_\alpha$ so that the heating time period $T_\beta$ is determined. Consequently, the cooking time period $T_\beta$ can be determined desirably even in the case of variations in the amount of food to be heated or fluctuations in the power source voltage.

The following TABLE 1 shows the evaluation criteria for the results of cooking with regard to various kinds of foods shown in TABLES 2 to 6 respectively. TABLE 2 shows the case of broiled salted Pacific saury, TABLE 3 broiled salted horse mackerel, TABLE 4 broiled yellowtail, TABLE 5 broiled Spanish mackerel and TABLE 6 broiled mackerel.

Referring to TABLE 1, evaluation is made on the basis of 7 points. Evaluation factors include degree of browning, temperature difference and change rate of weight. The temperature difference is obtained by measuring the temperatures at three portions of one or a fillet of fish. The change rate of weight is obtained from {(weight of fish after heating)÷(weight of fish before heating)}×100 [%]. An over-all judgment is obtained by subtracting demerit marks of the degree of browning, temperature difference and change rate of weight from 7 points. It can be said that a desirable finishing can be obtained when an over-all judgment is 4 or above.

TABLE 1

Evaluation criteria (on the basis of 7 points)

| Factor | Content | Demerit point |
|---|---|---|
| Degree of browning | Browned generally | 0 |
| | Partially browned dark or light | 1 |
| | Too burnt or too light | 2 |
| Temperature difference | 0 to 10° C. | 0 |
| | 11 to 20° C. | 1 |
| | 21° C. or above | 2 |
| Change rate of weight | 80 to 84% | 0 |
| | 85 to 89% | |
| | 75 to 79% | 1 |
| | 90% or above | |
| | 74% or below | 2 |

TABLE 2

Broiled salted Pacific saury (100 V 60 Hz)

| | | |
|---|---|---|
| Over-all judgment: | 6 | Initial temperature: 17° C. |
| Number of fish: | 4 | |
| Degree of browning: | demerit 1 | |
| Temperature difference: | demerit 0 | |
| Change rate of weight: | demerit 0 | |
| Over-all judgment: | 6 | Initial temperature: 73.1° C. |
| Number of fish: | 4 | |
| Degree of browning: | demerit 1 | |
| Temperature difference: | demerit 0 | |
| Change rate of weight: | demerit 0 | |
| Over-all judgment: | 7 | Initial temperature: 125° C. |
| Number of fish: | 4 | |
| Degree of browning: | demerit 0 | |
| Temperature difference: | demerit 0 | |
| Change rate of weight: | demerit 0 | |
| Over-all judgment: | 7 | Initial temperature: 179° C. |
| Number of fish: | 4 | |
| Degree of browning: | demerit 0 | |
| Temperature difference: | demerit 0 | |
| Change rate of weight: | demerit 0 | |
| Over-all judgment: | 6 | Initial temperature: 20° C. |
| Number of fish: | 2 | |
| Degree of browning: | demerit 1 | |
| Temperature difference: | demerit 0 | |
| Change rate of weight: | demerit 0 | |
| Over-all judgment: | 6 | Initial temperature: 90° C. |
| Number of fish: | 2 | |
| Degree of browning: | demerit 0 | |
| Temperature difference: | demerit 0 | |
| Change rate of weight: | demerit 1 | |
| Over-all judgment: | 7 | Initial temperature: 120° C. |
| Number of fish: | 2 | |
| Degree of browning: | demerit 0 | |
| Temperature difference: | demerit 0 | |
| Change rate of weight: | demerit 0 | |
| Over-all judgment: | 6 | Initial temperature: 160° C. |
| Number of fish: | 2 | |

TABLE 2-continued

Broiled salted Pacific saury (100 V 60 Hz)

| | | |
|---|---|---|
| Degree of browning: | demerit 0 | |
| Temperature difference: | demerit 0 | |
| Change rate of weight: | demerit 1 | |
| Over-all judgment: | 6 | Initial temperature: 35.4° C. |
| Number of fish: | 1 | |
| Degree of browning: | demerit 0 | |
| Temperature difference: | demerit 0 | |
| Change rate of weight: | demerit 2 | |
| Over-all judgment: | 7 | Initial temperature: 74° C. |
| Number of fish: | 1 | |
| Degree of browning: | demerit 0 | |
| Temperature difference: | demerit 0 | |
| Change rate of weight: | demerit 0 | |
| Over-all judgment: | 6 | Initial temperature: 122.5° C. |
| Number of fish: | 1 | |
| Degree of browning: | demerit 0 | |
| Temperature difference: | demerit 0 | |
| Change rate of weight: | demerit 1 | |

TABLE 3

Broiled salted horse mackerel (100 V 60 Hz)

| | | |
|---|---|---|
| Over-all judgment: | 5 | Initial temperature: 15.1° C. |
| Number of fish: | 4 | |
| Degree of browning: | demerit 1 | |
| Temperature difference: | demerit 0 | |
| Change rate of weight: | demerit 1 | |
| Over-all judgment: | 6 | Initial temperature: 74° C. |
| Number of fish: | 4 | |
| Degree of browning: | demerit 1 | |
| Temperature difference: | demerit 0 | |
| Change rate of weight: | demerit 0 | |
| Over-all judgment: | 7 | Initial temperature: 122° C. |
| Number of fish: | 4 | |
| Degree of browning: | demerit 0 | |
| Temperature difference: | demerit 0 | |
| Change rate of weight: | demerit 0 | |
| Over-all judgment: | 6 | Initial temperature: 175° C. |
| Number of fish: | 4 | |
| Degree of browning: | demerit 0 | |
| Temperature difference: | demerit 0 | |
| Change rate of weight: | demerit 1 | |
| Over-all judgment: | 6 | Initial temperature: 20° C. |
| Number of fish: | 2 | |
| Degree of browning: | demerit 0 | |
| Temperature difference: | demerit 0 | |
| Change rate of weight: | demerit 1 | |
| Over-all judgment: | 5 | Initial temperature: 90° C. |
| Number of fish: | 2 | |
| Degree of browning: | demerit 0 | |
| Temperature difference: | demerit 1 | |
| Change rate of weight: | demerit 1 | |
| Over-all judgment: | 7 | Initial temperature: 121° C. |
| Number of fish: | 2 | |
| Degree of browning: | demerit 0 | |
| Temperature difference: | demerit 0 | |
| Change rate of weight: | demerit 0 | |
| Over-all judgment: | 6 | Initial temperature: 152.1° C. |
| Number of fish: | 2 | |
| Degree of browning: | demerit 0 | |
| Temperature difference: | demerit 0 | |
| Change rate of weight: | demerit 1 | |
| Over-all judgment: | 5 | Initial temperature: 17° C. |
| Number of fish: | 1 | |
| Degree of browning: | demerit 0 | |
| Temperature difference: | demerit 0 | |
| Change rate of weight: | demerit 2 | |
| Over-all judgment: | 5 | Initial temperature: 70° C. |
| Number of fish: | 1 | |
| Degree of browning: | demerit 0 | |
| Temperature difference: | demerit 0 | |
| Change rate of weight: | demerit 2 | |
| Over-all judgment: | 5 | Initial temperature: 131.4° C. |
| Number of fish: | 1 | |
| Degree of browning: | demerit 0 | |
| Temperature difference: | demerit 0 | |
| Change rate of weight: | demerit 2 | |

TABLE 4

| Broiled yellowtail (100 V 60 Hz) | | |
|---|---|---|
| Over-all judgment: | 5 | Initial temperature: 25° C. |
| Number of fish: | 4 fillets | |
| Degree of browning: | demerit 0 | |
| Temperature difference: | demerit 1 | |
| Change rate of weight: | demerit 1 | |
| Over-all judgment: | 5 | Initial temperature: 77° C. |
| Number of fish: | 4 fillets | |
| Degree of browning: | demerit 0 | |
| Temperature difference: | demerit 1 | |
| Change rate of weight: | demerit 1 | |
| Over-all judgment: | 6 | Initial temperature: 127.5° C. |
| Number of fish: | 4 fillets | |
| Degree of browning: | demerit 0 | |
| Temperature difference: | demerit 1 | |
| Change rate of weight: | demerit 0 | |
| Over-all judgment: | 5 | Initial temperature: 155° C. |
| Number of fish: | 4 fillets | |
| Degree of browning: | demerit 0 | |
| Temperature difference: | demerit 1 | |
| Change rate of weight: | demerit 1 | |
| Over-all judgment: | 6 | Initial temperature: 23° C. |
| Number of fish: | 2 fillets | |
| Degree of browning: | demerit 0 | |
| Temperature difference: | demerit 1 | |
| Change rate of weight: | demerit 0 | |
| Over-all judgment: | 6 | Initial temperature: 79.8° C. |
| Number of fish: | 2 fillets | |
| Degree of browning: | demerit 0 | |
| Temperature difference: | demerit 1 | |
| Change rate of weight: | demerit 0 | |
| Over-all judgment: | 7 | Initial temperature: 134.2° C. |
| Number of fish: | 2 fillets | |
| Degree of browning: | demerit 0 | |
| Temperature difference: | demerit 0 | |
| Change rate of weight: | demerit 0 | |
| Over-all judgment: | 6 | Initial temperature: 25.6° C. |
| Number of fish: | 1 fillet | |
| Degree of browning: | demerit 0 | |
| Temperature difference: | demerit 1 | |
| Change rate of weight: | demerit 0 | |
| Over-all judgment: | 5 | Initial temperature: 77° C. |
| Number of fish: | 1 fillet | |
| Degree of browning: | demerit 0 | |
| Temperature difference: | demerit 1 | |
| Change rate of weight: | demerit 1 | |
| Over-all judgment: | 6 | Initial temperature: 125.7° C. |
| Number of fish: | 1 fillet | |
| Degree of browning: | demerit 0 | |
| Temperature difference: | demerit 1 | |
| Change rate of weight: | demerit 0 | |

TABLE 5

| Broiled Spanish mackerel (Saikyoyaki) (100 V 60 Hz) | | |
|---|---|---|
| Over-all judgment: | 5 | Initial temperature: 44.4° C. |
| Number of fish: | 4 fillets | |
| Degree of browning: | demerit 0 | |
| Temperature difference: | demerit 1 | |
| Change rate of weight: | demerit 1 | |
| Over-all judgment: | 5 | Initial temperature: 80° C. |
| Number of fish: | 4 fillets | |
| Degree of browning: | demerit 0 | |
| Temperature difference: | demerit 1 | |
| Change rate of weight: | demerit 1 | |
| Over-all judgment: | 5 | Initial temperature: 123.7° C. |
| Number of fish: | 4 fillets | |
| Degree of browning: | demerit 0 | |
| Temperature difference: | demerit 1 | |
| Change rate of weight: | demerit 1 | |
| Over-all judgment: | 5 | Initial temperature: 151.3° C. |
| Number of fish: | 4 fillets | |
| Degree of browning: | demerit 0 | |
| Temperature difference: | demerit 1 | |
| Change rate of weight: | demerit 1 | |
| Over-all judgment: | 6 | Initial temperature: 19.9° C. |
| Number of fish: | 1 fillets | |
| Degree of browning: | demerit 0 | |
| Temperature difference: | demerit 0 | |
| Change rate of weight: | demerit 1 | |

TABLE 5-continued

| Broiled Spanish mackerel (Saikyoyaki) (100 V 60 Hz) | | |
|---|---|---|
| Over-all judgment: | 5 | Initial temperature: 79° C. |
| Number of fish: | 2 fillets | |
| Degree of browning: | demerit 0 | |
| Temperature difference: | demerit 1 | |
| Change rate of weight: | demerit 1 | |
| Over-all judgment: | 6 | Initial temperature: 127.7° C. |
| Number of fish: | 2 fillets | |
| Degree of browning: | demerit 0 | |
| Temperature difference: | demerit 0 | |
| Change rate of weight: | demerit 1 | |
| Over-all judgment: | 6 | Initial temperature: 36.5° C. |
| Number of fish: | 1 fillets | |
| Degree of browning: | demerit 0 | |
| Temperature difference: | demerit 0 | |
| Change rate of weight: | demerit 1 | |
| Over-all judgment: | 7 | Initial temperature: 77° C. |
| Number of fish: | 1 fillets | |
| Degree of browning: | demerit 0 | |
| Temperature difference: | demerit 0 | |
| Change rate of weight: | demerit 0 | |
| Over-all judgment: | 6 | Initial temperature: 124.6° C. |
| Number of fish: | 1 fillets | |
| Degree of browning: | demerit 0 | |
| Temperature difference: | demerit 0 | |
| Change rate of weight: | demerit 1 | |

TABLE 6

| Broiled mackerel with citrol (100 V 60 Hz) | | |
|---|---|---|
| Over-all judgment: | 6 | Initial temperature: 28.9° C. |
| Number of fish: | 4 fillets | |
| Degree of browning: | demerit 0 | |
| Temperature difference: | demerit 1 | |
| Change rate of weight: | demerit 0 | |
| Over-all judgment: | 6 | Initial temperature: 90.7° C. |
| Number of fish: | 4 fillets | |
| Degree of browning: | demerit 0 | |
| Temperature difference: | demerit 1 | |
| Change rate of weight: | demerit 0 | |
| Over-all judgment: | 6 | Initial temperature: 125.4° C. |
| Number of fish: | 4 fillets | |
| Degree of browning: | demerit 0 | |
| Temperature difference: | demerit 1 | |
| Change rate of weight: | demerit 0 | |
| Over-all judgment: | 6 | Initial temperature: 159.7° C. |
| Number of fish: | 4 fillets | |
| Degree of browning: | demerit 0 | |
| Temperature difference: | demerit 1 | |
| Change rate of weight: | demerit 0 | |
| Over-all judgment: | 6 | Initial temperature: 23° C. |
| Number of fish: | 2 fillets | |
| Degree of browning: | demerit 0 | |
| Temperature difference: | demerit 1 | |
| Change rate of weight: | demerit 0 | |
| Over-all judgment: | 6 | Initial temperature: 57.1° C. |
| Number of fish: | 2 fillets | |
| Degree of browning: | demerit 0 | |
| Temperature difference: | demerit 1 | |
| Change rate of weight: | demerit 0 | |
| Over-all judgment: | 6 | Initial temperature: 146.5° C. |
| Number of fish: | 2 fillets | |
| Degree of browning: | demerit 0 | |
| Temperature difference: | demerit 1 | |
| Change rate of weight: | demerit 0 | |
| Over-all judgment: | 5 | Initial temperature: 18° C. |
| Number of fish: | 1 fillets | |
| Degree of browning: | demerit 1 | |
| Temperature difference: | demerit 0 | |
| Change rate of weight: | demerit 1 | |
| Over-all judgment: | 6 | Initial temperature: 70° C. |
| Number of fish: | 1 fillets | |
| Degree of browning: | demerit 1 | |
| Temperature difference: | demerit 0 | |
| Change rate of weight: | demerit 0 | |
| Over-all judgment: | 6 | Initial temperature: 125.8° C. |
| Number of fish: | 1 fillets | |
| Degree of browning: | demerit 1 | |
| Temperature difference: | demerit 0 | |

TABLE 6-continued

| Broiled mackerel with citrol (100 V 60 Hz) | |
|---|---|
| Change rate of weight: | demerit 0 |

TABLE 7 shows the over-all judgment in the occurrence of the voltage fluctuation in the power source for the heater. It can be understood that the desirable finishing can be obtained even in the occurrence of the voltage fluctuation. The reason for this can be as follows: for example, a heating power is increased when the power supply voltage is relatively large. This means that an amount of heated load relative to the increased heating power is rendered small and accordingly, the temperature difference $Y_\beta$ is rendered large. That is, the heating period of time is shortened since the amount of food to be heated is determined to be relatively small. Consequently, the fish is not broiled too much and a desirable finishing can be obtained. On the other hand, when the power supply voltage is relatively small, insufficiency of the broiling can be prevented and accordingly, the desirable finishing can be obtained.

TABLE 7

| | Voltage fluctuation | |
|---|---|---|
| Fish | Voltage | Over-all judgment |
| Four broiled salted | 95 V 60 Hz | 6 |
| Pacific sauries | 105 V 60 Hz | 6 |
| Two broiled salted | 95 V 60 Hz | 7 |
| Pacific sauries | 105 V 60 Hz | 6 |
| Four fillets of | 95 V 60 Hz | 6 |
| broiled yellowtail | 105 V 60 Hz | 6 |
| Two fillets of | 95 V 60 Hz | 6 |
| broiled yellowtail | 105 V 60 Hz | 6 |

The foregoing disclosure and drawings are merely illustrative of the principles of the present invention and are not to be interpreted in a limiting sense. The only limitation is to be determined from the scope of the appended claims.

I claim:

1. A heating apparatus comprising:

a) a heating chamber for accommodating food to be cooked by way of heating;

b) a heater for heating the food accommodated in the heating chamber;

c) a temperature sensor for sensing a temperature in the heating chamber, thereby generating a temperature signal indicative of the sensed temperature;

d) first means connected to the temperature sensor for obtaining an initial temperature on the basis of the temperature signal generated by the temperature sensor at an initial stage of the heating;

e) second means connected to the temperature sensor for obtaining an intermediate temperature on the basis of the temperature signal generated by the temperature sensor a predetermined period after the initial stage of the heating;

f) third means connected to the first and second means for obtaining the difference ($Y_\beta$) between the initial temperature obtained by the first means and the intermediate temperature obtained by the second means;

g) fourth means connected to the third means for determining a calorific capacity of the food on the basis of the difference ($Y_\beta$) obtained by the third means; and h) heating time period determining means connected to the fourth means for setting a heating period of time for the food on the basis of the calorific capacity determined by the fourth means.

2. A heating apparatus according to claim 1, wherein the heating time period determining means comprises storage means for storing determination data of fundamental heating time periods ($T_\alpha$) with respect to predetermined values of fundamental calorific capacity, the fundamental heating time periods being previously set in accordance with different initial temperatures in the heating chamber, means for specifying the fundamental heating time period ($T_\alpha$) corresponding to the initial temperature obtained by the first means, and means for compensating the specified heating time period on the basis of the determined calorific capacity, thereby obtaining the heating period of time for the food.

3. A heating apparatus according to claim 2, wherein the fundamental heating time periods are set in accordance with the kinds of foods to be heated.

4. A heating apparatus according to claim 11, wherein the determination data further includes a fundamental temperature difference ($Y_\alpha$) determined on the basis of the initial temperature, and the heating time period determining means determines the heating period of time based on a difference between the temperature difference ($Y_\beta$) and the fundamental temperature difference ($Y_\alpha$).

5. A heating apparatus according to claim 4, further comprising a clock display for displaying the heating period of time determined by the heating time period determining means.

6. A heating apparatus according to claim 4, further comprising an alcohol sensor for detecting an alcoholic content in the heating chamber and wherein the heating time period determining means determines whether the food accommodated in the heating chamber is marinated food or not, on the basis of a rate of change of the alcoholic content detected by the alcohol sensor, thereby compensating the determined heating period of time in accordance with a result of the determination as to whether the food accommodated in the heating chamber is marinated food or not.

7. A heating apparatus according to claim 4, wherein the heating time period determining means allots the determined heating period of time to a time period for broiling an obverse of the food and a time period for broiling a reverse of the food.

8. A heating apparatus according to claim 7, further comprising a character display and wherein the heating time period determining means operates the character display so that an indication of "Reverse" is displayed after lapse of the time period for broiling the obverse of the food.

9. A heating apparatus according to claim 1, further comprising a clock display for displaying the heating period of time determined by the heating time period determining means.

10. A heating apparatus according to claim 1, further comprising an alcohol sensor for detecting an alcoholic content in the heating chamber and wherein the heating time period determining means determines whether the food accommodated in the heating chamber is marinated food or not, on the basis of a rate of change of the alcoholic content detected by the alcohol sensor, thereby compensating the determined heating period of time in accordance with a result of the determination as to whether the food accommodated in the heating chamber is marinated food or not.

11. A heating apparatus according to claim 1, wherein the heating time period determining means allots the determined heating period of time to a time period for broiling an obverse of the food and a time period for broiling a reverse of the food.

12. A heating apparatus according to claim 11, further comprising a character display and wherein the heating time period determining means operates the character display so that an indication of "Reverse" is displayed after lapse of the time period for broiling the obverse of the food.

* * * * *